US007947937B1

(12) United States Patent
Langner

(10) Patent No.: US 7,947,937 B1
(45) Date of Patent: May 24, 2011

(54) LASER GUIDED PROJECTILE DEVICE AND METHOD THEREFOR

(76) Inventor: F. Richard Langner, Fountain Hills, AZ (US)

( * ) Notice: Subject to any disclaimer, the term of this patent is extended or adjusted under 35 U.S.C. 154(b) by 279 days.

(21) Appl. No.: 12/170,580

(22) Filed: Jul. 10, 2008

Related U.S. Application Data

(60) Provisional application No. 60/999,802, filed on Oct. 19, 2007.

(51) Int. Cl.

| | |
|---|---|
| ***F41G 7/20*** | (2006.01) |
| ***F41G 7/22*** | (2006.01) |
| ***F42B 15/01*** | (2006.01) |
| *F41G 7/00* | (2006.01) |
| *F42B 15/00* | (2006.01) |

(52) U.S. Cl. ..... 244/3.16; 244/3.1; 244/3.11; 244/3.15; 244/3.21; 244/3.24; 102/501; 102/517; 89/1.11

(58) Field of Classification Search ..... 244/3.1–3.3; 89/1.11; 102/382, 384, 430, 439, 473, 501, 102/517

See application file for complete search history.

(56) References Cited

U.S. PATENT DOCUMENTS

| | | | | |
|---|---|---|---|---|
| 4,024,392 | A * | 5/1977 | Teppo et al. | 244/3.16 |
| 4,231,533 | A * | 11/1980 | Durig | 244/3.16 |
| 4,324,491 | A * | 4/1982 | Hueber | 244/3.16 |
| 4,431,147 | A * | 2/1984 | Paley | 244/3.3 |
| 4,576,346 | A * | 3/1986 | Gauggel et al. | 244/3.16 |
| 4,733,609 | A * | 3/1988 | Goodwin et al. | 244/3.16 |
| 4,978,221 | A * | 12/1990 | Sepp | 244/3.17 |
| 5,088,659 | A * | 2/1992 | Neff et al. | 244/3.16 |
| 5,102,065 | A * | 4/1992 | Couderc et al. | 244/3.11 |
| 5,788,178 | A * | 8/1998 | Barrett, Jr. | 244/3.11 |
| 6,260,792 | B1 * | 7/2001 | Zwirn et al. | 244/3.11 |
| 6,262,800 | B1 * | 7/2001 | Minor | 244/3.16 |
| 6,371,405 | B1 * | 4/2002 | Sallee et al. | 244/3.16 |
| 6,422,507 | B1 * | 7/2002 | Lipeles | 244/3.13 |
| 6,626,396 | B2 * | 9/2003 | Secker | 244/3.16 |
| 6,724,470 | B2 * | 4/2004 | Barenz et al. | 244/3.16 |
| 6,919,840 | B2 * | 7/2005 | Friedrich et al. | 244/3.16 |
| 7,533,849 | B2 * | 5/2009 | Zemany et al. | 244/3.16 |

* cited by examiner

*Primary Examiner* — Bernarr E Gregory
(74) *Attorney, Agent, or Firm* — Karen J. S. Fouts; Craig Weiss; Weiss & Moy, P.C.

(57) ABSTRACT

A laser guided projectile device and method for shooting the device through a percussion actuated non-electric disrupter or dearmer to disable or destroy improvised explosive devices, bombs, or other ordnance. The device can include a cartridge case, a laser housing, a laser module, and a projectile head. An aperture in the projectile head permits a laser beam to be emitted through the head and projected onto a target to facilitate increased shooting accuracy of the disrupter or dearmer. The device can include O-rings positioned around the laser housing and projectile head that assist in aligning the device within the disrupter or dearmer and that also provide a seal for gases that are emitted during detonation, thereby assisting in the propulsion of the device during firing. The projectile head can be interchangeable and can be rounded or cone-shaped or can comprise a shot cup.

20 Claims, 10 Drawing Sheets

LASER GUIDED PROJECTILE DEVICE AND METHOD THEREFOR

RELATED APPLICATION

This non-provisional application claims priority from provisional application No. 60/999,802, filed on Oct. 19, 2007.

FIELD OF THE INVENTION

This invention relates generally to laser sighting devices used in the disablement and destruction of improvised explosive devices, bombs, and other ordnance.

BACKGROUND OF THE INVENTION

Percussion actuated non-electric (PAN) disrupters or dearmers are often used by military personnel, bomb squads, and other emergency service personnel in the destruction and disablement of improvised explosive devices (IEDs) and other bombs and/or ordnance. A typical PAN disrupter comprises a heavy duty 12-gauge shotgun barrel which can be operated remotely through the use of a robot, for example, in order to facilitate firing of the device from a safe distance. The PAN disrupter is often engaged electrically or by a shock tube. Such a PAN disrupter uses specially designed 12-gauge shotgun ammunition in conjunction with various sighting methods which predominantly use a laser sight.

Typically, laser sighting devices are either attached to or positioned adjacent to the PAN disrupter barrel in order to align the barrel with the IED. Due to the angle of the laser in relation to the centerline of the barrel, making an accurate shot can be difficult, since doing so depends upon the barrel being positioned in such a way as to precisely correspond to a point at which the laser intersects the centerline of the barrel. This level of precision is especially critical when, for example, the user is required to hit a particular spot on the IED, such as a small 9-volt battery. In addition, it is very difficult to properly locate the barrel when it has been positioned on a robot, for example, and can only be viewed from a distance or through a television camera that has been mounted on the robot.

A need therefore exists for a laser sighting device that facilitates increased shooting accuracy without requiring precise positioning of a disrupter, dearmer, or other ammunition application in relation to the laser.

The present invention satisfies these needs and provides other, related advantages.

SUMMARY OF THE INVENTION

In accordance with one embodiment of the present invention, a laser guided projectile device is disclosed. The laser guided projectile device comprises, in combination: a cartridge case; a laser housing adapted to be coupled to the cartridge case; a laser module adapted to be positioned within the laser housing; and a projectile head adapted to be coupled to the laser housing.

In accordance with another embodiment of the present invention, a laser guided projectile device is disclosed. The laser guided projectile device comprises, in combination: a cartridge case comprising a casing having a base at a first end and a mouth at a second end, the cartridge case containing a primer, a powder charge, and a seal; a battery cap comprising a body portion and a head portion, wherein the battery cap is adapted to be inserted in the cartridge case and positioned proximate the mouth thereof; a laser housing comprising a casing having a base portion, a body portion, and a head portion, the body portion including a first plurality of openings and a second plurality of openings, wherein the first plurality of openings is adapted to receive a plurality of screws for aligning a laser module within the laser housing and the second plurality of openings are adapted to receive room temperature vulcanizing silicone rubber, the head portion including an aperture adapted to permit a laser beam to be emitted therethrough, the laser housing containing a plurality of battery cells, a contact spring, and the laser module, wherein the base portion of the laser housing is adapted to be inserted in the mouth of the cartridge case and removably coupled to the head portion of the battery cap; a projectile head comprising a base portion, an O-ring groove, and a frontal portion, the frontal portion including an aperture adapted to align with the aperture in the head portion of the laser housing and to permit a laser beam to be emitted therethrough, wherein the base portion of the projectile head is adapted to be removably coupled to the head portion of the laser housing; and a plurality of O-rings, wherein a first plurality of O-rings is positioned around the body portion of the battery cap, a second plurality of O-rings is positioned around the laser module, a third plurality of O-rings is positioned around the body portion of the laser housing, and at least one O-ring is positioned in the O-ring groove of the projectile head.

In accordance with a further embodiment of the present invention, a method for shooting a laser guided projectile is disclosed. The method comprises the steps of: providing a combination disrupter and projectile device comprising, in combination: a PAN disrupter; and a laser guided projectile device comprising, in combination: a cartridge case comprising a casing having a base at a first end and a mouth at a second end, the cartridge case containing a primer, a powder charge, and a seal; a battery cap comprising a body portion and a head portion, wherein the battery cap is adapted to be inserted in the cartridge case and positioned proximate the mouth thereof; a laser housing comprising a casing having a base portion, a body portion, and a head portion, the body portion including a first plurality of openings and a second plurality of openings, wherein the first plurality of openings is adapted to receive a plurality of screws for aligning a laser module within the laser housing and the second plurality of openings are adapted to receive room temperature vulcanizing silicone rubber, the head portion including an aperture adapted to permit a laser beam to be emitted therethrough, the laser housing containing a plurality of battery cells, a contact spring, and the laser module, wherein the base portion of the laser housing is adapted to be inserted in the mouth of the cartridge case and removably coupled to the head portion of the battery cap; a projectile head comprising a base portion, an O-ring groove, and a frontal portion, the frontal portion including an aperture adapted to align with the aperture in the head portion of the laser housing and to permit a laser beam to be emitted therethrough, wherein the base portion of the projectile head is adapted to be removably coupled to the head portion of the laser housing; and a plurality of O-rings, wherein a first plurality of O-rings is positioned around the body portion of the battery cap, a second plurality of O-rings is positioned around the laser module, a third plurality of O-rings is positioned around the body portion of the laser housing, and at least one O-ring is positioned in the O-ring groove of the projectile head; applying a coating of one of petroleum jelly and silicone grease to the O-rings on the laser housing and the projectile head; loading the laser guided projectile device into the PAN disrupter; and firing the laser guided projectile device from the PAN disrupter.

DETAILED DESCRIPTION OF THE PREFERRED EMBODIMENTS

Figure 1:
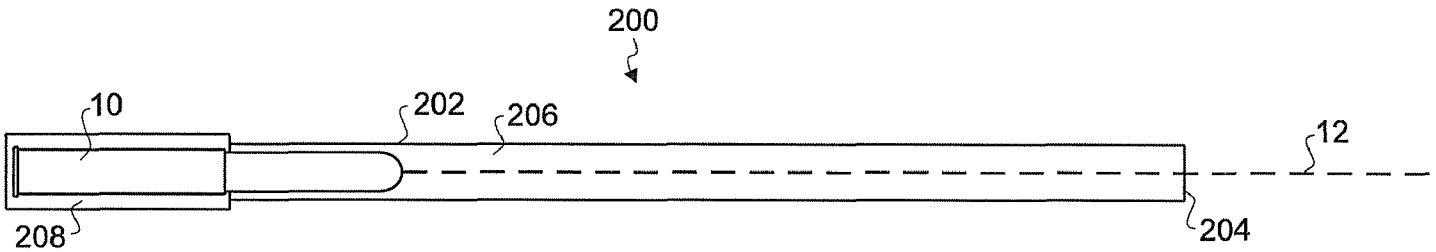
FIG. 1 depicts a side, cross-sectional view of a PAN disrupter with a laser guided projectile device positioned therein, consistent with an embodiment of the present invention.

Referring first to FIG. 1, an embodiment of a laser guided projectile device 10, consistent with an embodiment of the present invention is shown. The laser guided projectile device 10 may be used in conjunction with a commercially available percussion actuated non-electric (PAN) disrupter (or dearmer) 200, or in combination with various other forms of ammunition applications, for disabling and/or destroying improvised explosive devices (IEDs), bombs, other ordnance, and for other special applications. The laser guided projectile device 10 is capable of projecting a laser beam 12 through the bore 206 of the PAN disrupter 200 and onto a target. The laser beam 12 of the laser guided projectile device 10 facilitates increased shooting accuracy of the PAN disrupter 200, such that it may be on target from virtually any reasonable range, without the need for precisely aligning the barrel 202 of the PAN disrupter 200 in relation to a laser beam such as those used with standard laser sighting devices, as discussed further below.

Figure 2:
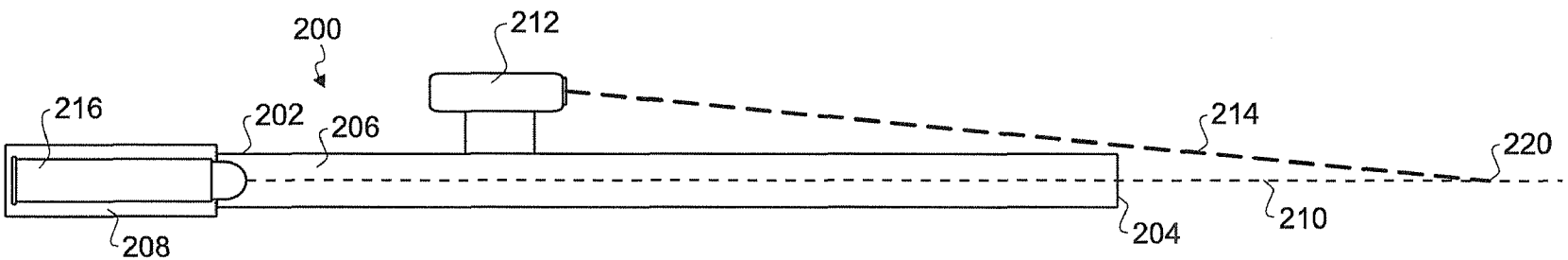
Fig. 2 (Prior Art)
FIG. 2 is a side, cross-sectional view of a prior art PAN disrupter with a prior art laser sighting device positioned thereon.

The PAN disrupter 200 generally comprises a heavy-duty 12-gauge shotgun barrel 202 having a muzzle end 204, a bore 206, and a chamber 208. The PAN disrupter 200 may be operated according to standard protocol, which may generally include being operated electrically or by a shock tube in order to permit firing of the device from a safe distance. The PAN disrupter 200 employs specially designed 12-gauge shotgun ammunition in conjunction with various sighting methods, including those using a laser sight. For example, standard commercially available PAN disrupters have employed laser sighting devices that are attached to or adjacent to the PAN disrupters' barrels. FIG. 2 shows an example of a typical prior art PAN disrupter 200 having a laser sighting device 212 attached thereto. The laser sighting device 212 emits a laser beam 214. Specially designed 12-gauge shotgun ammunition 216 is shown positioned within the chamber 208. A centerline 210 of the bore 206 is indicated by dotted lines running through a center portion of the PAN disrupter 200. As seen in FIG. 2, and as demonstrated at a location 220 at which the laser beam 214 intersects the centerline 210, due to the angle of the laser beam 214 in relation to the centerline 210, the barrel 202 must be positioned in such a way as to precisely correspond to location 220 in order for an accurate shot to be made. Thus, the PAN disrupter 200 employing laser sight 212 is limited to being precisely on target at one specific range.

Figure 7:
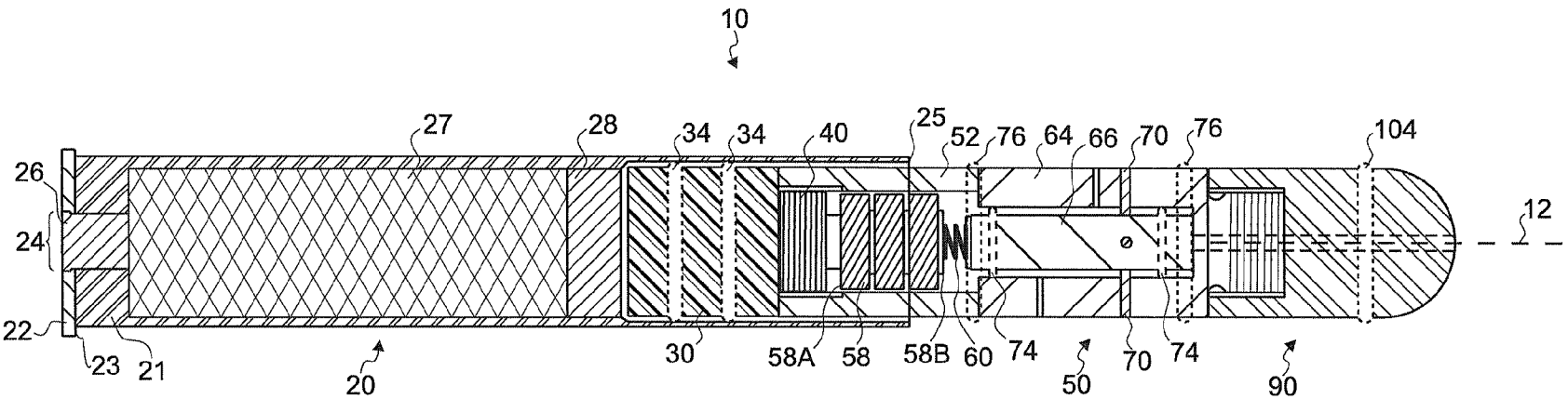
FIG. 7 is a side, cross-sectional view of a fully assembled laser guided projectile device, consistent with an embodiment of the present invention.
Figure 8:
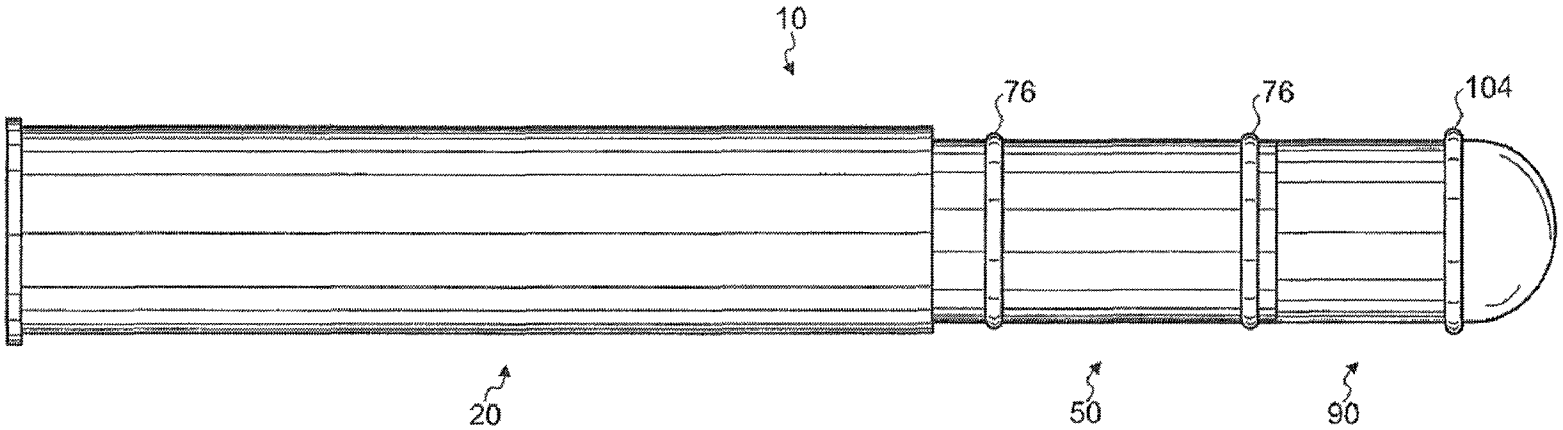
FIG. 8 is a side view of a fully assembled laser guided projectile device, consistent with an embodiment of the present invention.

Turning to FIGS. 7 and 8, an embodiment of a laser guided projectile device 10 of the present invention is shown. The laser guided projectile device 10 can be broken down into the following main components: a cartridge case (or propellant container) 20, a battery cap 30 (as shown in FIG. 7), a laser housing 50, and an interchangeable projectile head 90. While in this embodiment projectile head 90 is shown, various other interchangeable projectile heads, including projectile heads 110, 130, and 150 (as seen in FIGS. 11-13 and 15-17), may be used with the laser guided projectile device 10, as further discussed below.

Figure 3:
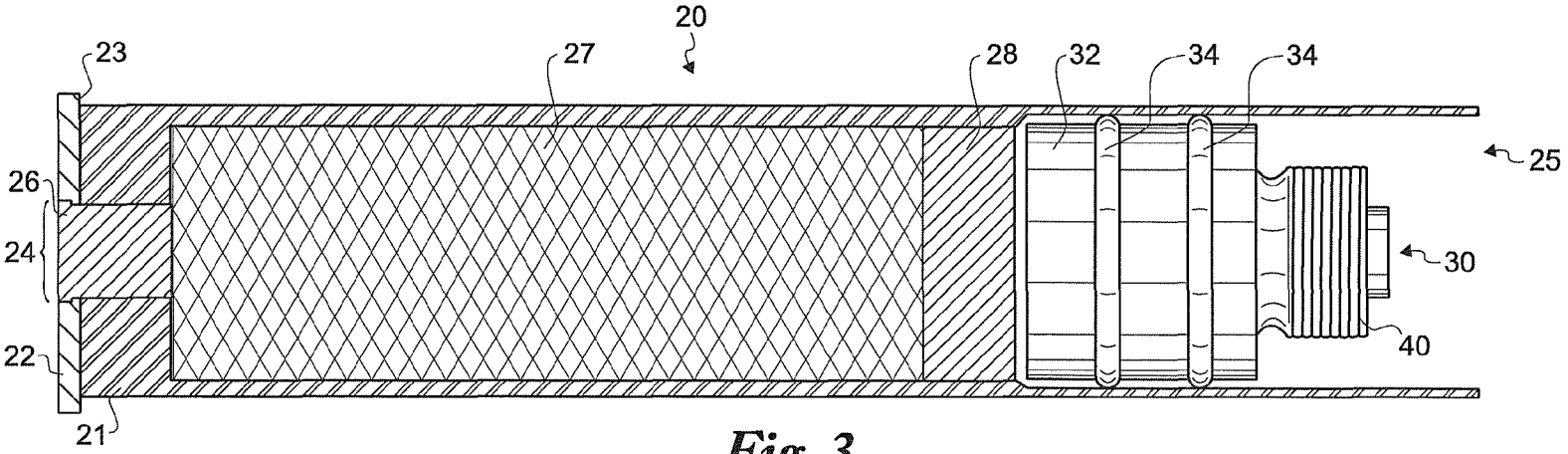
FIG. 3 is a side, cross-sectional view of a cartridge case portion of the laser guided projectile device of the present invention, showing a battery cap positioned therein, consistent with an embodiment of the present invention.

Turning to FIG. 3, a detailed view of the cartridge case 20 is shown in cross-section. The cartridge case 20 comprises a substantially cylindrical casing 21 having a base 22 and a mouth 25. The base 22 preferably comprises a substantially ring-shaped cap defining an opening 24, to permit a primer 26 to be positioned therein. In this embodiment, the base 22 further includes a rim 23. The mouth 25 is adapted to receive the battery cap 30 and a portion of the laser housing 50 (as seen in FIGS. 7 and 8, for example), as further discussed below. The cartridge case 20 is further adapted to contain a powder charge 27 and a seal (wad) 28. Preferably, the cartridge case 20 is 12-gauge size, in order to correspond to PAN disrupters having 12-gauge shotgun barrels, although it may be desired to provide a cartridge case 20 of a different gauge, so long as such a different gauge corresponds to a gauge of a PAN disrupter's shotgun barrel with which the cartridge case 20 is to be employed. The cartridge case 20 is preferably formed of anodized aluminum, although it should be clearly understood that substantial benefit could be derived from a cartridge case 20 formed of other suitable materials, including various metals.

Figure 4:
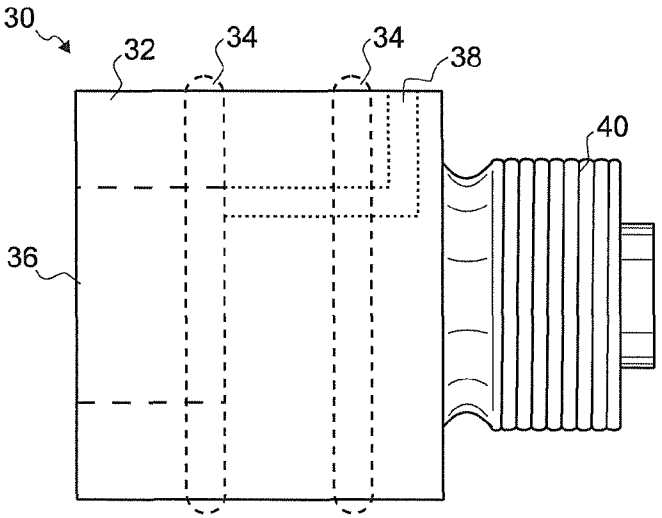
FIG. 4 is a side view of the battery cap shown in FIG. 3, with portions thereof shown in phantom.

Referring to FIGS. 3 and 4, the battery cap 30 generally comprises two main sections: a body portion 32 and a head portion 40. The body portion 32 is substantially cylindrical-shaped and is adapted to be positioned within the cartridge case 20 proximate the mouth 25 thereof, as seen in FIG. 3. The body portion 32 preferably includes O-rings 34 positioned around an outer surface thereof. The O-rings 34 provide a seal for gases that are emitted when the powder charge 27 is detonated, thereby assisting in propelling the laser guided projectile device 10 when it is fired from the PAN disrupter 200 or other suitable ammunition application. The O-rings 34 may assist in aligning the battery cap 30 within the cartridge case 20. While in this embodiment two O-rings 34 are employed, it may be desired to incorporate a different number of O-rings 34. In one embodiment, the body portion 32 may include grooves for receiving the O-rings 34. As seen in FIG. 4, the body portion 32 further includes an open area 36 and a vent hole 38. The vent hole 38 is adapted to relieve compressed air as the battery cap 30 is inserted into the mouth 25 of the cartridge case 20. As shown in this embodiment, the head portion 40 of the battery cap 30 is threaded. In this way, the battery cap 30 is adapted to be coupled to the laser housing 50 (as seen in FIG. 7, for example), as further discussed below. Preferably, the battery cap 30 is bonded to the seal (wad) 28 with hot melt glue (not shown). The bond breaks free when the powder charge 27 is detonated. The hot melt glue provides an additional gas seal and prevents the battery cap 30 from turning when the laser housing 50 (as seen in FIG. 7, for example) is being attached to the battery cap 30. The battery cap 30 may be formed of aluminum or some other suitable metal.

Figure 5:
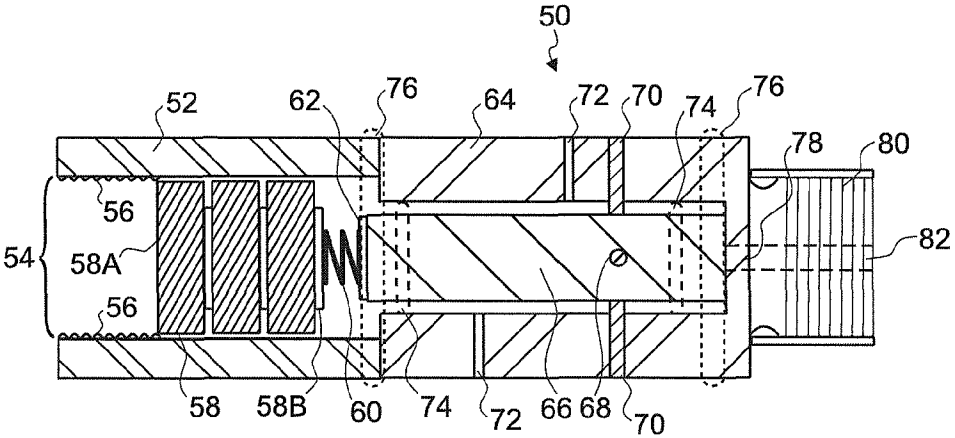
FIG. 5 is a side, cross-sectional view of a laser housing portion of the laser guided projectile device of the present invention, consistent with an embodiment of the present invention.
Figure 19B:
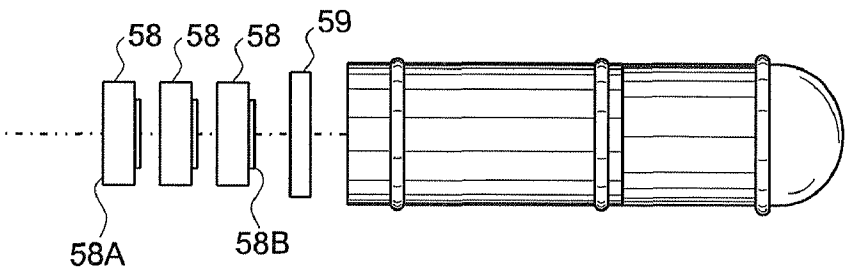
FIG. 19B is a side, partially exploded view of the laser housing and projectile head portions of FIG. 19A, with a rubber plug thereof removed.
Figure 19A:
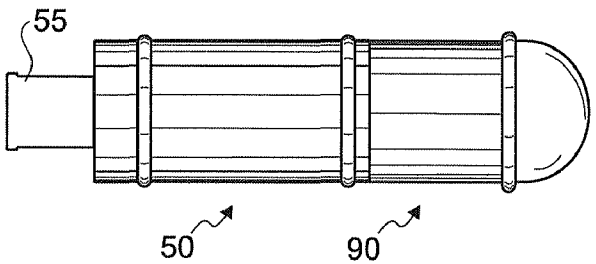
FIG. 19A is a side view of laser housing and projectile head portions of a laser guided projectile device, consistent with an embodiment of the present invention.

Turning now to FIG. 5, a detailed view of the laser housing 50 is shown in cross-section. The laser housing 50 comprises a substantially cylindrical casing and is adapted to contain a plurality of battery cells 58, a laser contact spring 60, and a laser module 66. The laser housing 50 is further adapted to receive a plug 55 and a contact insulator 59, as shown in FIGS. 19A and 19B, respectively, and as discussed further below.

In this embodiment, the laser housing 50 generally includes a base portion 52, a body portion 64, and a head portion 80. The base portion 52 includes an opening 54 and is adapted to receive the battery cells 58. The battery cells 58 each have a positive terminal 58A and a negative terminal 58B. The battery cells 58 are connected serially, such that the positive terminal 58A of a first battery cell 58 is connected to a negative terminal 58B of a second battery cell 58, a positive terminal 58A of a second battery cell 58 is connected to a negative terminal 58B of a third battery cell 58, and so on. While in this embodiment three battery cells 58 are employed, it may be desired for the laser housing 50 to incorporate a different number of battery cells 58. In one embodiment, the battery cells 58 may comprise conventional 1.5V alkaline button cells, such as LR44 or SR44 button cells, or the like. It may also be desired to employ a different type of battery cell with the laser guided projectile device 10. An interior portion 56 of the laser housing 50 at the base portion 52 is preferably threaded in such a way as to correspond with the threading on the head portion 40 of the battery cap 30, as discussed above. In this way, the laser housing 50 may be coupled to the head portion 40 of the battery cap 30 (as seen in FIG. 7, for example). In a preferred embodiment, the interior portion 56 includes ½"-28 threading.

The body portion 64 of the laser housing 50 is adapted to contain the laser module 66. In one embodiment, the laser module 66 comprises a laser which may have various wavelengths, from visible to infrared, and various output powers, depending upon the application. The body portion 64 includes an aperture 78 through which the beam from the laser module 66 may be emitted. O-rings 74 are positioned around the laser module 66. The body portion 64 of the laser housing 50 further includes a plurality of openings 68 through which screws 70 may be inserted. The screws 70 assist in aligning and adjusting the laser module 66 so that it is properly positioned within the laser housing 50. During and after adjustment of the laser module 66, the O-rings 74 assist in stabilizing the laser module 66 within the laser housing 50. Preferably, four openings 68 are included in the body portion 64 for accommodating four screws 70. However, it may be desired for the body portion 64 to include more than four or less than four such openings 68. Each screw 70 is preferably positioned approximately 90 degrees from adjacent screws 70. As shown in this embodiment, the body portion 64 of the laser housing 50 further includes RTV injection holes 72. The RTV injection holes 72 are adapted to receive room temperature vulcanizing silicone rubber (RTV silicone) (not shown). The RTV silicone assists in stabilizing the laser module 66 within the laser housing 50 after it has been adjusted via the screws 70. While in this embodiment two RTV injection holes 72 are employed, it may be desired for the body portion 64 to include more than two or less than two RTV injection holes 72.

As seen in this embodiment, the head portion 80 of the laser housing 50 is threaded. In this way, the laser housing 50 is adapted to be coupled to various interchangeable projectile heads 90, 110, 130 and 150 (as seen in FIGS. 10-17), as further discussed below. The head portion 80 of the laser housing 50 includes an aperture 82, which aligns with aperture 78, and through which laser light from the laser module 66 may be emitted.

With respect to the circuitry of the laser guided projectile device 10, when the laser guided projectile device 10 is fully assembled (as seen in FIG. 7, for example) the laser module 66 may provide a positive electrical path through the screws 70 to body portion 64 and base portion 52 of the laser housing 50 and through the threading on the head portion 40 of the battery cap 30 to reach the positive terminal 58A of the series of battery cells 58. The laser contact spring 60 may provide a negative electrical path directly to the negative terminal 58B of the series of battery cells 58.

Figure 6:
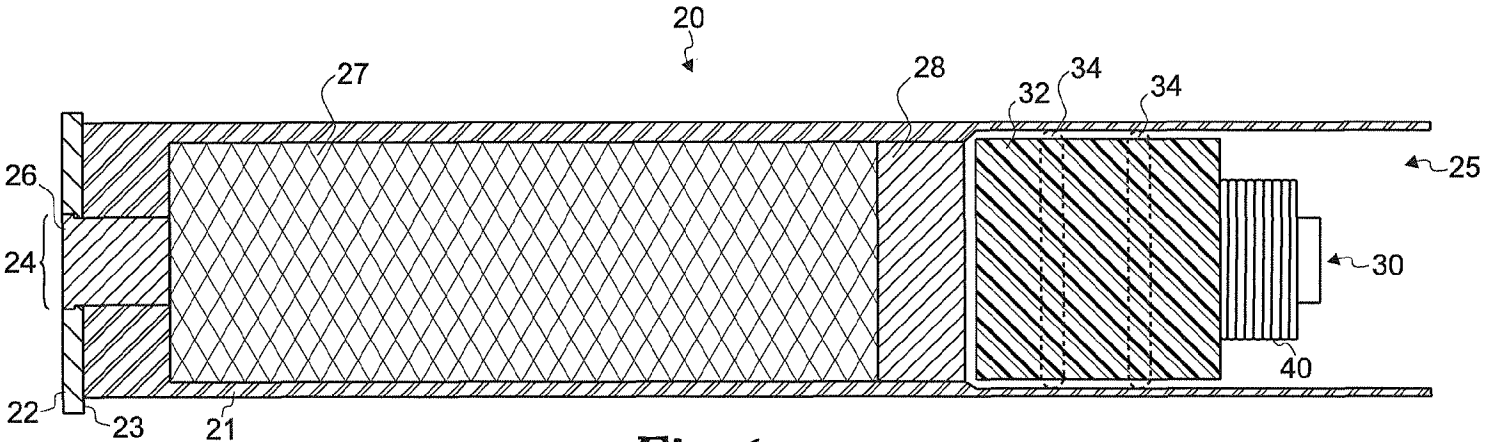
FIG. 6 is a side, cross-sectional view of a cartridge case portion of the laser guided projectile device of the present invention, showing a battery cap positioned therein, consistent with an embodiment of the present invention.

The exterior of the laser housing 50 includes a plurality of grooves adapted to receive O-rings 76. The O-rings 76 provide a seal for gases that are emitted when the powder charge 27 (shown in FIG. 6, for example) is detonated, thereby assisting in propelling the laser guided projectile device 10 when it is fired from the PAN disrupter 200 or other suitable ammunition application. The laser housing 50 is preferably formed of anodized aluminum, with the exception of the interior portion 56 of the laser housing 50, which is preferably not anodized in order to allow for the positive electrical path to reach the positive terminal 58A of the series of battery cells 58, as discussed above. It should be clearly understood, however, that substantial benefit could be derived from a laser housing 50 formed of other suitable materials, including various metals.

Figure 10:
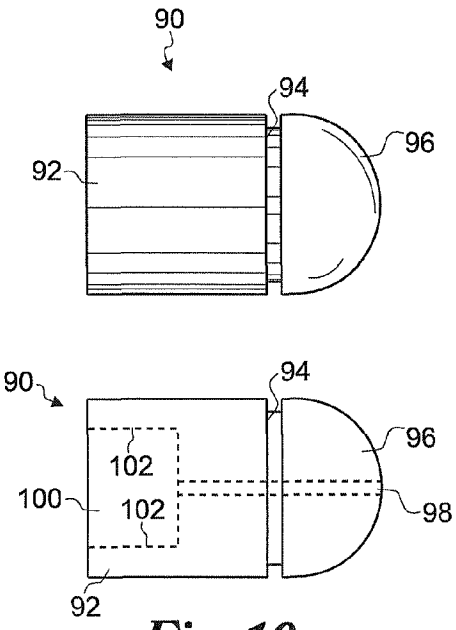
FIG. 10 depicts two side views of a projectile head for a laser guided projectile device, with one side view showing internal structure thereof, consistent with an embodiment of the present invention.

Turning now to FIGS. 10-13, various interchangeable projectile heads 90 (FIG. 10), 110 (FIG. 11), 130 (FIG. 12), and 150 (FIG. 13) are shown, consistent with an embodiment of the present invention. Each projectile head is adapted to be coupled to the laser housing 50, as discussed further below. Referring first to FIG. 10, projectile head 90 generally includes a base portion 92, an O-ring groove 94, and a frontal portion 96. The base portion 92 comprises a substantially cylindrical-shaped body having an opening 100 with an interior cylindrical side wall 102. The side wall 102 is preferably threaded in such a way as to correspond with the threading on the head portion 80 of the laser housing 50, as discussed above. In this way, the projectile head 90 may be coupled to the head portion 80 of the laser housing 50 (as shown in FIG. 14), as discussed further below. In one embodiment, the side wall 102 includes ½"-28 threading and measures approximately 0.420" in length. In one embodiment, an exterior diameter of the base portion 92 measures approximately 0.720". The O-ring groove 94 is adapted to receive an O-ring 104 (shown in FIG. 14). The O-ring 104 may provide a seal for gases that are emitted when the powder charge 27 is detonated, thereby assisting in propelling the laser guided projectile device 10 when it is fired from the PAN disrupter 200 or other suitable ammunition application. In one embodiment, the O-ring groove 94 measures approximately 0.070" in width and 0.055" in depth. The frontal portion 96 of the projectile head 90, in this embodiment, is substantially rounded. In this embodiment, the frontal portion 96 measures approximately 0.350" in length and has a radius of approximately 0.3245". The projectile head 90 further includes an aperture 98, which extends from opening 100 in the base portion 92 and through the frontal portion 96. When the laser guided projectile device 10 is fully assembled to include projectile head 90 and the laser module 66 (discussed above) is activated, laser light emitted from the laser module 66 may pass through aperture 98 and may be directed toward a target. In one embodiment, aperture 98 has a diameter of approximately 0.065". In one embodiment, projectile head 90 has an overall length of approximately 1.250". Projectile head 90 is preferably composed of anodized aluminum, but may be composed of some other metal or suitable material. In one embodiment, projectile head 90 may have a total weight of approximately 0.6 ounces. While the various components of projectile head 90 have been described with reference to various dimensions thereof, it should be clearly understood that substantial benefit could be derived from alternative configurations of projectile head 90 in which different dimensions are employed, including those that deviate from the preferred dimensions, even substantially, in either direction.

Figure 11:
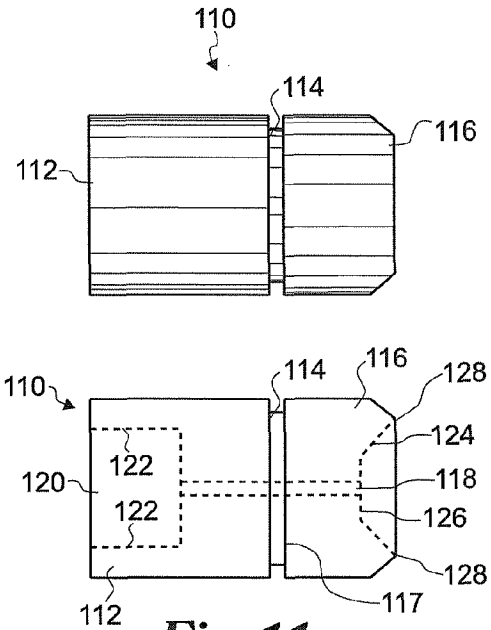
FIG. 11 depicts two side views of a projectile head for a laser guided projectile device, with one side view showing internal structure thereof, consistent with an embodiment of the present invention.
Figure 15:
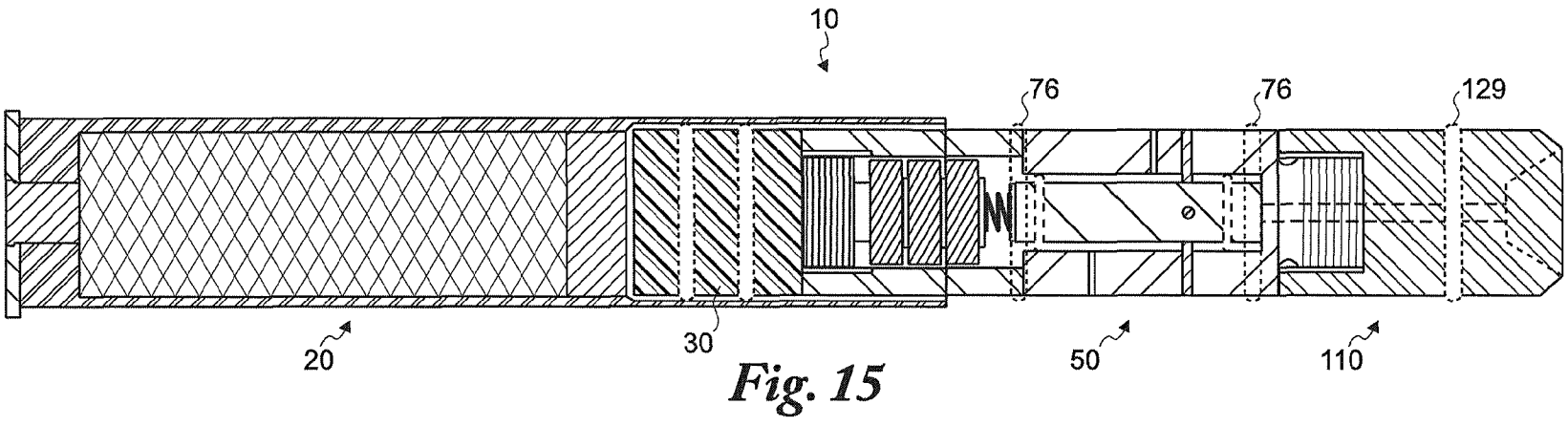
FIG. 15 is a side, cross-sectional view of a fully assembled laser guided projectile device, consistent with an embodiment of the present invention.

Referring now to FIG. 11, projectile head 110 generally includes a base portion 112, an O-ring groove 114, and a frontal portion 116. The base portion 112 comprises a substantially cylindrical-shaped body having an opening 120 with an interior cylindrical side wall 122. The side wall 122 is preferably threaded in such a way as to correspond with the threading on the head portion 80 of the laser housing 50, as discussed above. In this way, the projectile head 110 may be coupled to the head portion 80 of the laser housing 50 (as shown in FIG. 15), as discussed further below. In one embodiment, the side wall 122 includes ½"-28 threading and measures approximately 0.420" in length. In one embodiment, an exterior diameter of the base portion 112 measures approximately 0.720", with the base portion 112 measuring approximately 0.680" in length. The O-ring groove 114 is adapted to receive an O-ring 129 (shown in FIG. 15). The O-ring 129 may provide a seal for gases that are emitted when the powder charge 27 is detonated, thereby assisting in propelling the laser guided projectile device 10 when it is fired from the PAN disrupter 200 or other suitable ammunition application. In one embodiment, the O-ring groove 114 measures approximately 0.070" in width and 0.055" in depth. The frontal portion 116 includes a concave portion defined by a substantially cone-shaped side wall 124 and a base wall 126. In this embodiment, the side wall 124 includes a circular edge 128 measuring approximately 0.5625" in diameter. The edge 128 is preferably sharpened, to help facilitate the penetration of projectile head 110 through such materials as steel plate and other rigid materials. In this embodiment, the base wall 126 measures approximately 0.250" in length. The base wall 126 may be positioned approximately 0.250" from an edge 117 of the frontal portion 116. In this embodiment, the frontal portion 116 measures approximately 0.500" in overall length. The projectile head 110 further includes an aperture 118, which extends from opening 120 in the base portion 112 and through the frontal portion 116. When the laser guided projectile device 10 is fully assembled to include projectile head 110, and the laser module 66 (discussed above) is activated, laser light emitted from the laser module 66 may pass through aperture 118 and may be directed toward a target. In one embodiment, aperture 118 has a diameter of approximately 0.065". In one embodiment, projectile head 110 has an overall length of approximately 1.250". Projectile head 110 is preferably composed of hardened steel, but may be composed of some other metal or suitable material. In one embodiment, projectile head 110 may have a total weight of approximately 1.7 ounces. While the various components of projectile head 110 have been described with reference to various dimensions thereof, it should be clearly understood that substantial benefit could be derived from alternative configurations of projectile head 110 in which different dimensions are employed, including those that deviate from the preferred dimensions, even substantially, in either direction.

Figure 12:
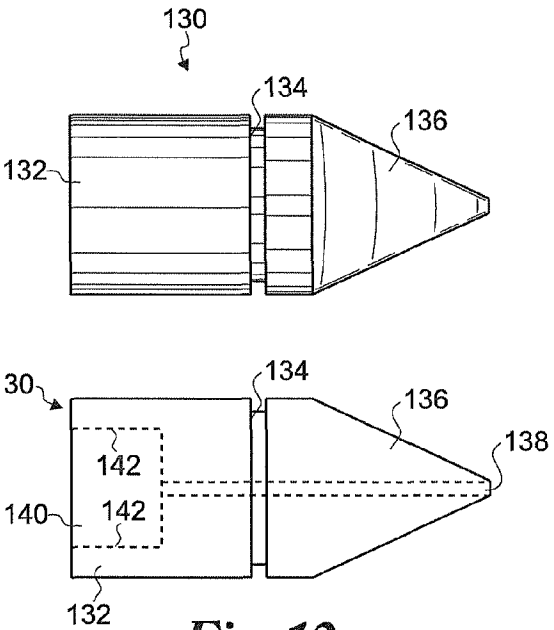
FIG. 12 depicts two side views of a projectile head for a laser guided projectile device, with one side view showing internal structure thereof, consistent with an embodiment of the present invention.
Figure 16:
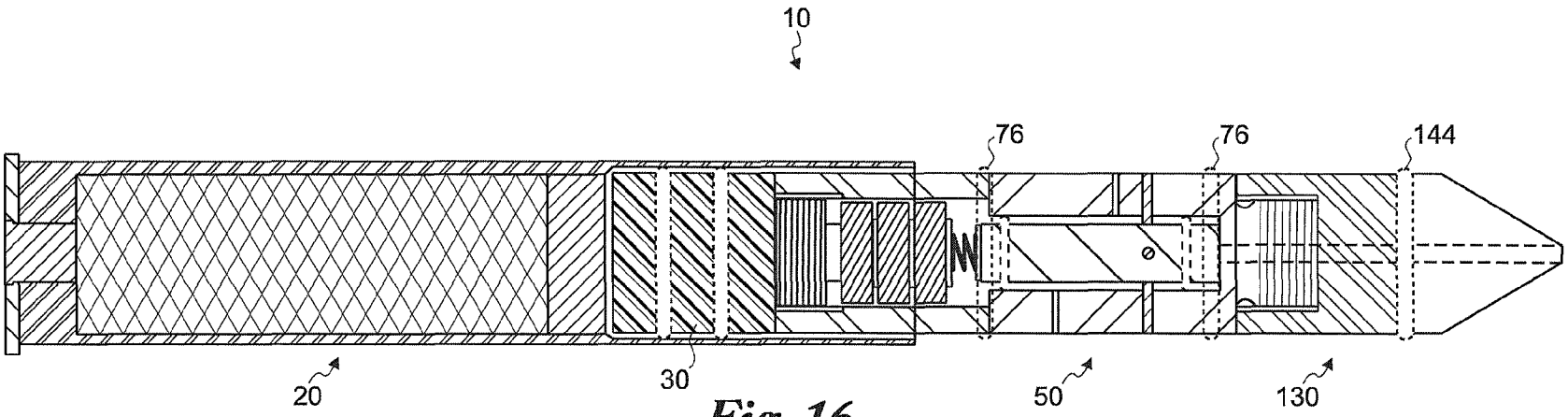
FIG. 16 is a side, cross-sectional view of a fully assembled laser guided projectile device, consistent with an embodiment of the present invention.

Referring now to FIG. 12, projectile head 130 generally includes a base portion 132, an O-ring groove 134, and a frontal portion 136. The base portion 132 comprises a substantially cylindrical-shaped body having an opening 140 with an interior cylindrical side wall 142. The side all 142 is preferably threaded in such a way as to correspond with the threading on the head portion 80 of the laser housing 50, as discussed above. In this way, the projectile head 130 may be coupled to the head portion 80 of the laser housing 50 (as shown in FIG. 16), as discussed further below. In one embodiment, the side wall 142 includes ½"-28 threading and measures approximately 0.420" in length. In one embodiment, an exterior diameter of the base portion 132 measures approximately 0.720". The O-ring groove 134 is adapted to receive an O-ring 144 (shown in FIG. 16). The O-ring 144 may provide a seal for gases that are emitted when the powder charge 27 is detonated, thereby assisting in propelling the laser guided projectile device 10 when it is fired from the PAN disrupter 200 or other suitable ammunition application. In one embodiment, the O-ring groove 134 measures approximately 0.070" in width and 0.055" in depth. The frontal portion 136 is substantially cone-shaped. In this embodiment, the frontal portion 136 measures approximately 0.500" in length. The projectile head 130 further includes an aperture 138, which extends from opening 140 in the base portion 132 and through the frontal portion 136. When the laser guided projectile device 10 is fully assembled to include projectile head 130 and the laser module 66 (discussed above) is activated, laser light emitted from the laser module 66 may pass through aperture 138 and may be directed toward a target. In one embodiment, aperture 138 has a diameter of approximately 0.065". In one embodiment, projectile head 130 has an overall length of approximately 1.200". Projectile head 130 is preferably composed of hardened steel, but may be composed of some other metal or suitable material. While the various components of projectile head 130 have been described with reference to various dimensions thereof, it should be clearly understood that substantial benefit could be derived from alternative configurations of projectile head 130 in which different dimensions are employed, including those that deviate from the preferred dimensions, even substantially, in either direction.

Figure 13:
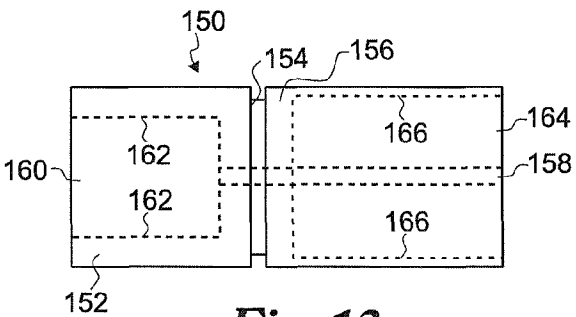
FIG. 13 depicts a side view of a projectile head for a laser guided projectile device, showing internal structure thereof, consistent with an embodiment of the present invention.
Figure 14:
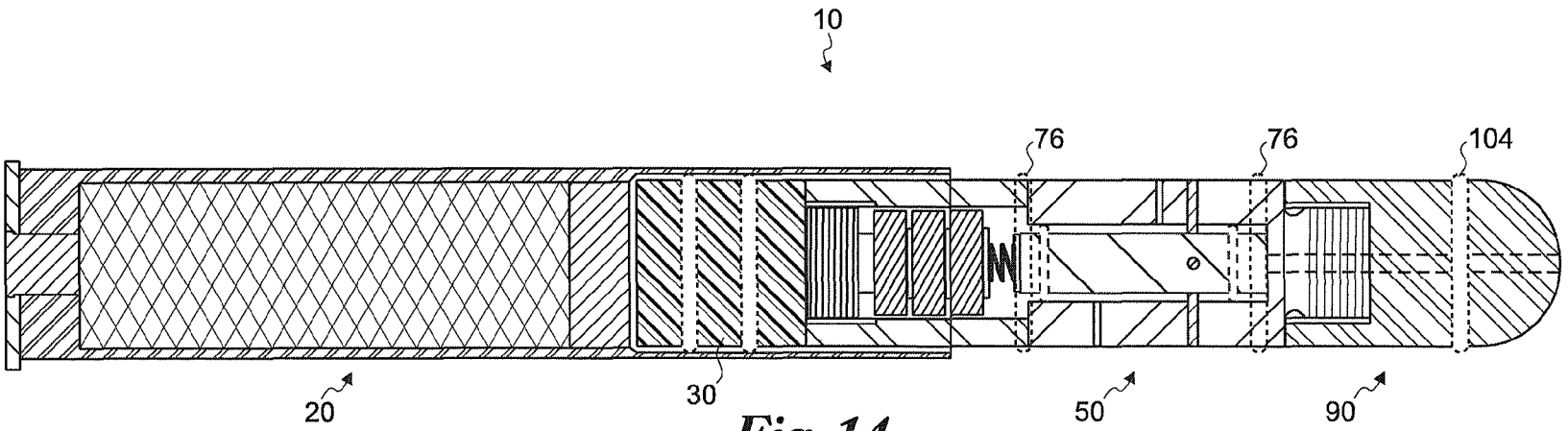
FIG. 14 is a side, cross-sectional view of a fully assembled laser guided projectile device, consistent with an embodiment of the present invention.
Figure 17:
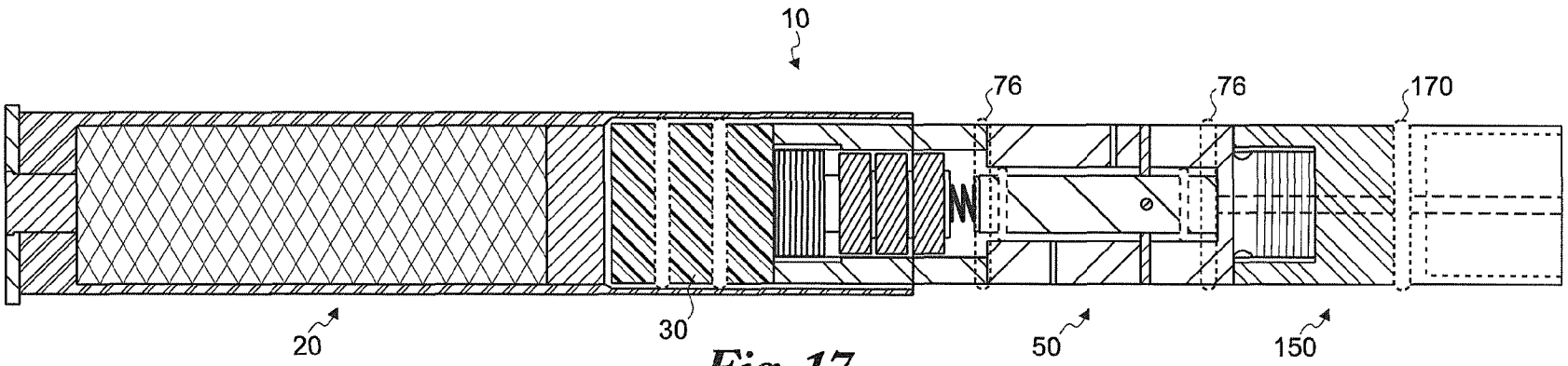
FIG. 17 is a side, cross-sectional view of a fully assembled laser guided projectile device, consistent with an embodiment of the present invention.

Referring now to FIG. 13, projectile head 150 generally includes a base portion 152, an O-ring groove 154, and a frontal portion 156. The base portion 152 comprises a substantially cylindrical-shaped body having an opening 160 with an interior cylindrical side wall 162. The side wall 162 is preferably threaded in such a way as to correspond with the threading on the head portion 80 of the laser housing 50, as discussed above. In this way, the projectile head 150 may be coupled to the head portion 80 of the laser housing 50 (as shown in FIG. 17), as discussed further below. In one embodiment, the side wall 162 includes ½"-28 threading and measures approximately 0.420" in length. In this embodiment, the base portion 152 measures approximately 0.500" in length and has an exterior diameter of approximately 0.720". The O-ring groove 154 is adapted to receive an O-ring 170 (shown in FIG. 17). In one embodiment, the O-ring groove 154 measures approximately 0.070" in width and 0.055" in depth. The frontal portion 156 is substantially cylindrical. In this embodiment, the frontal portion 156 measures approximately 1.250" in length and has an exterior diameter of approximately 0.720". The frontal portion 156 includes shot cup 164, which is adapted to contain various loads, such as clay and steel shot, or some other suitable load. Shot cup 164 is substantially cylindrical, having a side wall 166. In one embodiment, side wall 166 has a length of approximately 1.125", with the shot cup 164 having a diameter of approximately 0.620". The projectile head 150 further includes a tube 158, which extends from opening 160 in the base portion 152 and through the frontal portion 156. In one embodiment, the tube 158 is composed of brass, but may be composed of some other suitable material. When the laser guided projectile device 10 is fully assembled to include projectile head 150 and the laser module 66 (discussed above) is activated, laser light emitted from the laser module 66 may pass through tube 158 and may be directed toward a target. In one embodiment, tube 158 has a diameter of approximately 0.125". Projectile head 150 is preferably composed of anodized aluminum, but may be composed of some other metal or suitable material. While the various components of projectile head 150 have been described with reference to various dimensions thereof, it should be clearly understood that substantial benefit could be derived from alternative configurations of projectile head 150 in which different dimensions are employed, including those that deviate from the preferred dimensions, even substantially, in either direction.

Figure 9:
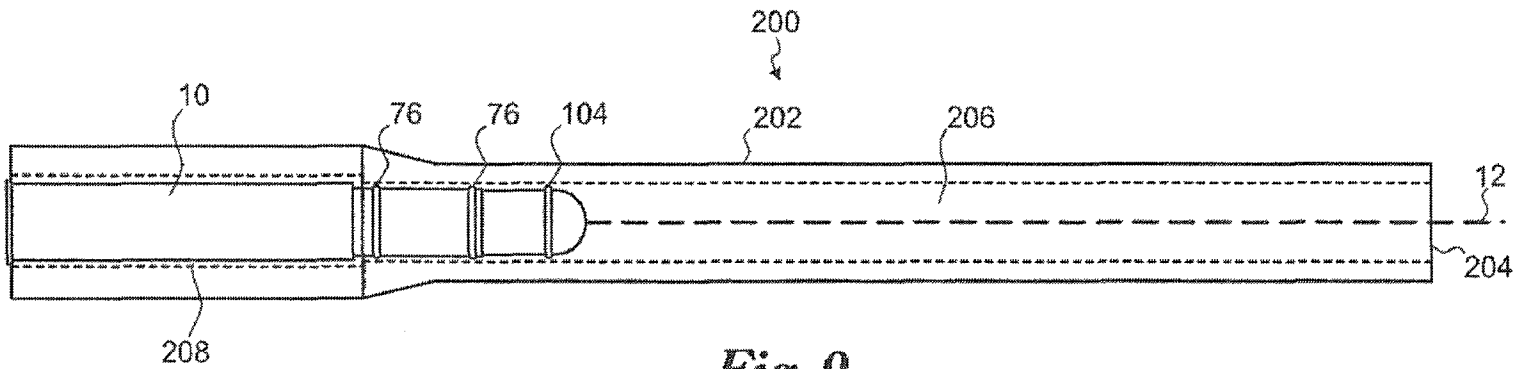
FIG. 9 is a side, cross-sectional view of a PAN disrupter showing a laser guided projectile device positioned therein, consistent with an embodiment of the present invention.

Referring now to FIGS. 14-17, embodiments of the laser guided projectile device 10 are shown fully assembled, including the various interchangeable projectile heads 90, 110, 130, and 150. In each of FIGS. 14-17, the battery cap 30 is shown positioned within the cartridge case 20, a portion of the laser housing 50 (including O-rings 76) is positioned within a portion of the cartridge case 20 and coupled to the battery cap 30, and one of the various interchangeable projectile heads 90, 110, 130, or 150 (including O-rings 104, 129, 144, or 170) is coupled to the laser housing 50. The O-ring 76 positioned on the laser housing 50, as well as the O-rings 104, 129, 144, and 170 positioned on the interchangeable projectile heads 90, 110, 130, and 150, respectively, assist in aligning the fully assembled laser guided projectile device 10 within the barrel 202 of the PAN disrupter 200 (as shown in FIG. 9, for example). The O-rings 76, 104, 129, 144, and 170 also help guide the laser guided projectile device 10 as it propels down the barrel 202.

Figure 18:
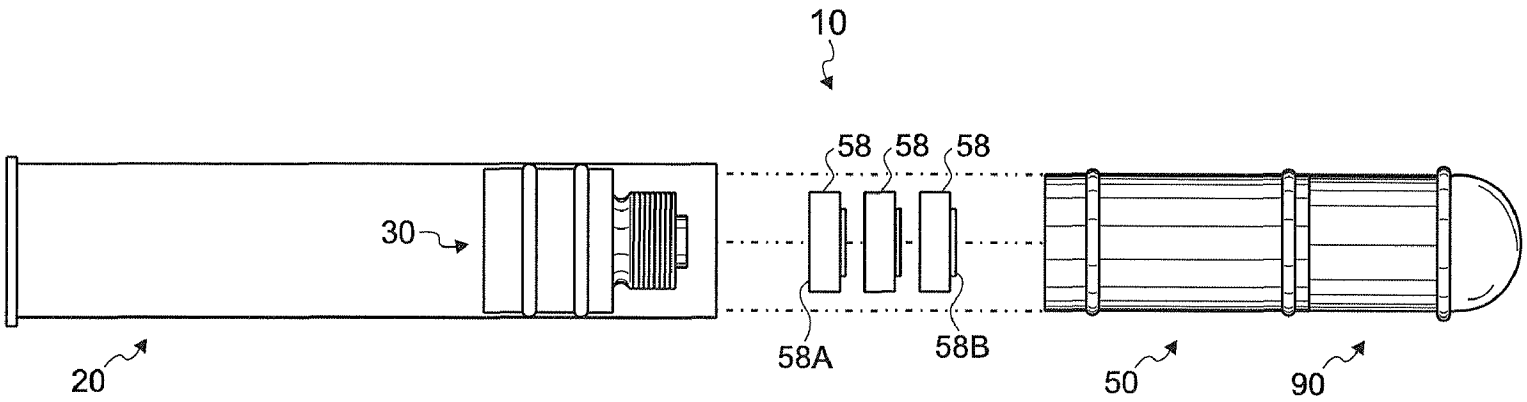
FIG. 18 is a side, partially exploded view of a laser guided projectile device, consistent with an embodiment of the present invention.

Referring now to FIG. 18, positioning of the main components of the laser guided projectile device 10 is demonstrated. The battery cap 30 is shown positioned within the cartridge case 20. The battery cells 58 are adapted to be inserted in the laser housing 50, with the negative terminals 58B of the battery cells 58 oriented toward the laser housing 50. The laser housing 50, with projectile head 90 coupled thereto, is adapted to be connected to the battery cap 30. While in this embodiment projectile head 90 is shown, it should be clearly understood that the various other interchangeable projectile heads may be coupled to the laser housing 50, as previously discussed.

Figure 20:
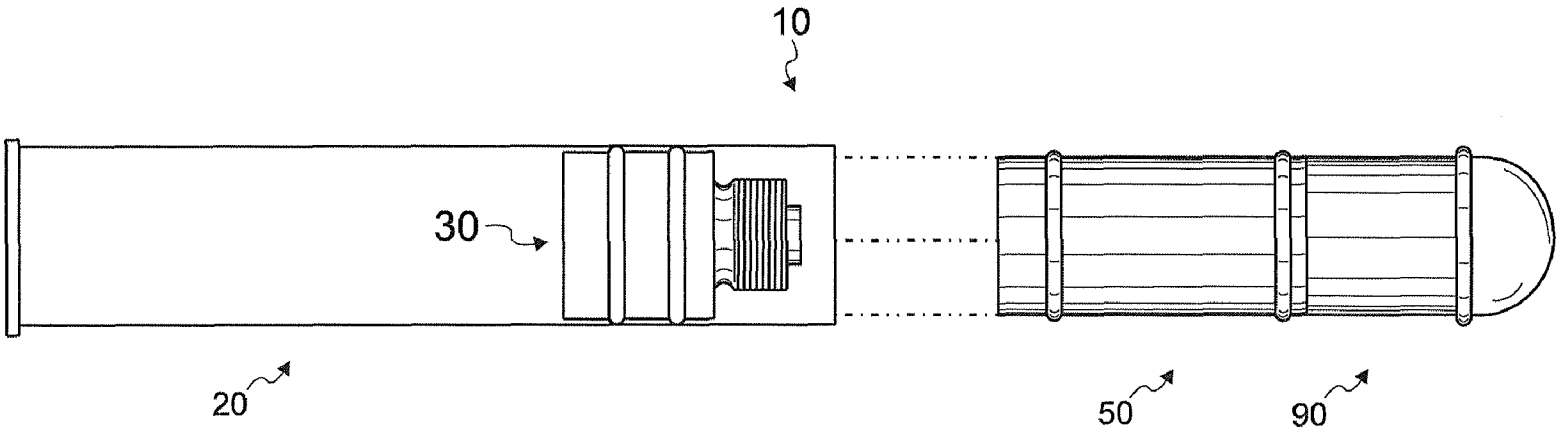
FIG. 20 is a side, partially exploded view of a laser guided projectile device, consistent with an embodiment of the present invention.

Referring now to FIGS. 19A, 19B and 20, assembly of the laser guided projectile device 10 is shown. Turning first to FIG. 19A, in one embodiment, the laser guided projectile device 10 may be provided to a user in an unassembled condition. In this embodiment, the projectile head 90 is coupled to the laser housing 50. The battery cells 58 (as seen in FIG. 19B) and a contact insulator 59 (as seen in FIG. 19B) are maintained in position within the laser housing 50 by a removable plug 55. The plug 55 is adapted to secure the battery cells 58 and contact insulator 59 in the laser housing 50 until such time that a user desires to employ the laser guided projectile device 10. In one embodiment, the plug 55 may be a rubber plug. The contact insulator 59 is preferably disc-shaped. The contact insulator 59 may be comprised of plastic or some other suitable material.

In assembling the laser guided projectile device 10, the user would first remove the plug 55 from the laser housing 50, in order to access the battery cells 58. The user would next remove the battery cells 58 from the laser housing 50, in order to access the contact insulator 59. The user would discard the contact insulator 59 and plug 55. The user would re-insert the battery cells 58 in the laser housing 50. Referring to FIG. 20, the user would then couple the laser housing 50 (with the projectile head 90 attached thereto) to the cartridge case 20, by screwing the laser housing 50 onto the head portion 40 of the battery cap 30. In this way, the laser module 66 will be activated and emit a laser beam 12 (as seen in FIG. 7). In order to deactivate the laser beam 12, the user would unscrew the laser housing 50 from the battery cap 30. In this embodiment, turning the laser housing 50 in a clockwise direction activates the laser module 66, while turning the laser housing 50 in a counterclockwise direction deactivates the laser module 66. When assembling the laser guided projectile device 10, a user would take care to point the laser housing 50 downrange, away from any personnel. A user would also take care to avoid direct eye exposure with the laser beam 12 and not look directly into the laser beam 12. In this embodiment, once the laser guided projectile device 10 is fully assembled and the laser module 66 activated, the life of the battery cells 58 may be approximately one hour, which should allow sufficient time for the user to acquire a target. While in this embodiment projectile head 90 is shown, it should be clearly understood that the various other interchangeable projectile heads may be used with the laser guided projectile device 10, as previously discussed.

Figure 21:
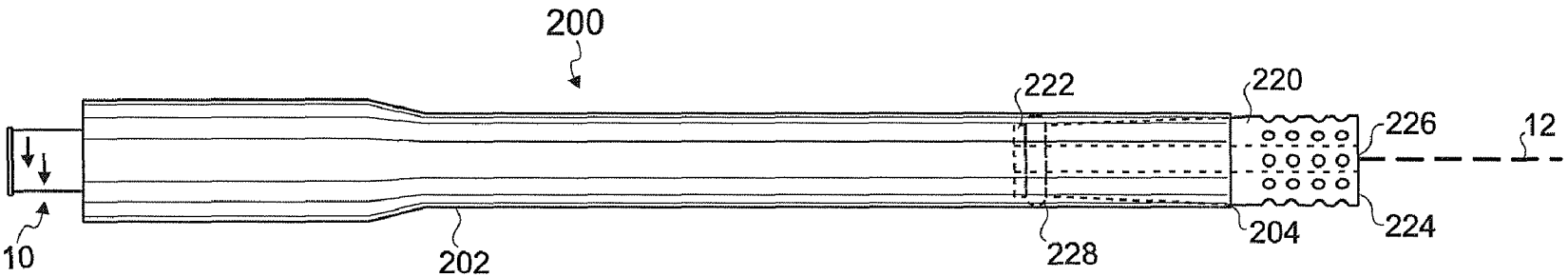
FIG. 21 is a side view of a PAN disrupter with a laser guided projectile device and a muzzle adapter device positioned therein, consistent with an embodiment of the present invention.

Referring now to FIG. 21, positioning of the laser guided projectile device 10 within the PAN disrupter 200 is shown. In this embodiment, a muzzle adapter device 220 is employed. In this embodiment, the muzzle adapter device 220 is a substantially elongated cylindrical device having a first end 222 adapted to be inserted in the muzzle end 204 of the PAN disrupter 200 and a second end 224. The first end is preferably tapered, in order to facilitate the insertion of the muzzle adapter device 220 in the PAN disrupter 200. Preferably, the muzzle adapter device 220 further includes an O-ring 228, positioned proximate the first end 222 of the muzzle adapter device 220. An aperture 226 runs through a center of the muzzle adapter device 220. In one embodiment, the aperture 226 has a diameter of approximately 0.045". The aperture 226 is adapted to permit laser light emitted from the laser module 66 of the laser guided projectile device 10 to pass therethrough. The muzzle adapter device 220 is preferably comprised of anodized aluminum, but could be constructed from various other suitable materials. The muzzle adapter device 220 assists in aligning the laser beam 12 of the laser guided projectile device 10 so that it is centered within the bore 206 (as seen in FIG. 1) of the PAN disrupter 200. Before inserting the muzzle adapter device 220 into the PAN disrupter 200, a user would take care to ensure that the bore 206 of the PAN disrupter 200 is clean. Once the user determines that the bore 206 is clean, the user may position the muzzle adapter device 220 in the PAN disrupter 200.

Preferably, prior to positioning the laser guided projectile device 10 within the PAN disrupter 200, the user would apply a coating of petroleum jelly or silicone grease to the O-rings 76 on the laser housing 50 and, depending on the particular projectile head being employed, to the O-ring 104 on projectile head 90, to the O-ring 129 on projectile head 110, to the O-ring 144 on projectile head 130, or to the O-ring 170 on projectile head 150. The coating of petroleum jelly or silicone grease is preferably a liberal coating. The petroleum jelly or silicone grease lubricates the O-rings so that the laser guided projectile device 10 passes through the barrel 202 of the PAN disrupter 200 with minimal friction. This also assists in minimizing barrel wear. The user would next partially insert the laser guided projectile device 10 into the PAN disrupter 200, as shown in FIG. 21. In one embodiment, the user may insert the laser guided projectile device 10 into the PAN disrupter 200 such that approximately ½" of the cartridge case 20 of the laser guided projectile device 10 protrudes from the PAN disrupter 200. Next, the user would aim the muzzle end 204 of the PAN disrupter 200 at a white or substantially light-colored background, in order to view the laser beam 12 from the laser guided projectile device 10 being emitted thereon. Preferably, the user would position the muzzle end 204 of the PAN disrupter 200 within approximately twelve inches from the background. Next, the user would rotate the laser guided projectile device 10 until a laser spot resulting from the laser beam 12 is at its brightest. In this embodiment, a user would take care to rotate the laser guided projectile device 10 in a clockwise direction only, as rotating the laser guided projectile device 10 in a counterclockwise direction will result in the battery cap 30 becoming unscrewed from the laser housing 50 and the laser guided projectile device 10 thereby becoming disassembled. After ensuring that the laser spot is at its brightest, the user would then completely insert the laser guided projectile device 10 into the chamber 208 of the PAN disrupter 200 and then remove the muzzle adapter device 220 from the PAN disrupter 200. Complete insertion of the laser guided projectile device 10 in the chamber 208 of the PAN disrupter 200 is demonstrated in FIG. 9, for example. As shown in this embodiment, the laser guided projectile device 10 is seated and aligned within the barrel 202, with the laser beam 12 substantially centered within the bore 206. Once the laser guided projectile device 10 has been completely inserted into the PAN disrupter 200, the user would make preparations for and then proceed with making a shot.

While the invention has been particularly shown and described with reference to the preferred embodiments thereof, it will be understood by those skilled in the art that the foregoing and other changes in form and details may be made therein without departing from the spirit and scope of the invention.

I claim:

1. A gun-fired laser guided projectile device comprising, in combination:

a cartridge case;

a laser housing adapted to be coupled to the cartridge case;

a laser module adapted to be positioned within the laser housing; and a projectile head adapted to be coupled to the laser housing.

2. The laser guided projectile device of claim 1 wherein the cartridge case comprises a casing having a base at a first end and a mouth at a second end, the cartridge case containing a primer, a powder charge, and a seal.

3. The laser guided projectile device of claim 1 wherein the laser housing comprises a casing having a base portion, a body portion, and a head portion, the head portion including an aperture adapted to permit a laser beam to be emitted therethrough, the laser housing containing a power supply, wherein the base portion of the laser housing is adapted to be inserted in the cartridge case.

4. The laser guided projectile device of claim 3 wherein the body portion of the laser housing includes a first plurality of openings and a second plurality of openings, wherein the first plurality of openings is adapted to receive a plurality of screws for aligning the laser module within the laser housing and the second plurality of openings are adapted to receive room temperature vulcanizing silicone rubber.

5. The laser guided projectile device of claim 3 wherein the projectile head comprises a base portion, an O-ring groove, and a frontal portion, the frontal portion including an aperture adapted to align with the aperture in the head portion of the laser housing and to permit a laser beam to be emitted therethrough.

6. The laser guided projectile device of claim 1 wherein the projectile head is comprised of one of steel and anodized aluminum.

7. The laser guided projectile device of claim 1 wherein a frontal portion of the projectile head is one of substantially rounded and cone-shaped.

8. The laser guided projectile device of claim 1 wherein a frontal portion of the projectile head includes a concave portion defined by a substantially cone-shaped side wall and a base wall, the side wall having an upper sharpened edge.

9. The laser guided projectile device of claim 1 wherein a frontal portion of the projectile head comprises a shot cup.

10. The laser guided projectile device of claim 1 further comprising a plurality of O-rings, wherein a first plurality of O-rings is positioned around a battery cap positioned in the cartridge case, a second plurality of O-rings is positioned around the laser module, a third plurality of O-rings is positioned around the laser housing, and at least one O-ring is positioned in an O-ring groove of the projectile head.

11. The laser guided projectile device of claim 1 wherein the frontal portion of the projectile head includes a concave portion defined by a substantially cone-shaped side wall and a base wall, the side wall having an upper sharpened edge.

12. A laser guided projectile device comprising, in combination:

a cartridge case comprising a casing having a base at a first end and a mouth at a second end, the cartridge case containing a primer, a powder charge, and a seal;

a battery cap comprising a body portion and a head portion, wherein the battery cap is adapted to be inserted in the cartridge case and positioned proximate the mouth thereof;

a laser housing comprising a casing having a base portion, a body portion, and a head portion, the body portion including a first plurality of openings and a second plurality of openings, wherein the first plurality of openings is adapted to receive a plurality of screws for aligning a laser module within the laser housing and the second plurality of openings are adapted to receive room temperature vulcanizing silicone rubber, the head portion including an aperture adapted to permit a laser beam to be emitted therethrough, the laser housing containing a plurality of battery cells, a contact spring, and the laser module, wherein the base portion of the laser housing is adapted to be inserted in the mouth of the cartridge case and removably coupled to the head portion of the battery cap;

a projectile head comprising a base portion, an O-ring groove, and a frontal portion, the frontal portion including an aperture adapted to align with the aperture in the head portion of the laser housing and to permit a laser beam to be emitted therethrough, wherein the base portion of the projectile head is adapted to be removably coupled to the head portion of the laser housing; and a plurality of O-rings, wherein a first plurality of O-rings is positioned around the body portion of the battery cap, a second plurality of O-rings is positioned around the laser module, a third plurality of O-rings is positioned around the body portion of the laser housing, and at least one O-ring is positioned in the O-ring groove of the projectile head.

13. The laser guided projectile device of claim 12 wherein the frontal portion of the projectile head is one of substantially rounded and cone-shaped.

14. The laser guided projectile device of claim 12 wherein the frontal portion of the projectile head comprises a shot cup.

15. The laser guided projectile device of claim 14 further comprising a tube positioned within the projectile head.

16. A method for shooting a laser guided projectile, comprising the steps of: providing a combination disrupter and projectile device comprising, in combination:

a PAN disrupter; and a laser guided projectile device comprising, in combination:

a cartridge case comprising a casing having a base at a first end and a mouth at a second end, the cartridge case containing a primer, a powder charge, and a seal;

a battery cap comprising a body portion and a head portion, wherein the battery cap is adapted to be inserted in the cartridge case and positioned proximate the mouth thereof;

a laser housing comprising a casing having a base portion, a body portion, and a head portion, the body portion including a first plurality of openings and a second plurality of openings, wherein the first plurality of openings is adapted to receive a plurality of screws for aligning a laser module within the laser housing and the second plurality of openings are adapted to receive room temperature vulcanizing silicone rubber, the head portion including an aperture adapted to permit a laser beam to be emitted therethrough, the laser housing containing a plurality of battery cells, a contact spring, and the laser module, wherein the base portion of the laser housing is adapted to be inserted in the mouth of the cartridge case and removably coupled to the head portion of the battery cap;

a projectile head comprising a base portion, an O-ring groove, and a frontal portion, the frontal portion including an aperture adapted to align with the aperture in the head portion of the laser housing and to permit a laser beam to be emitted therethrough, wherein the base portion of the projectile head is adapted to be removably coupled to the head portion of the laser housing; and a plurality of O-rings, wherein a first plurality of O-rings is positioned around the body portion of the battery cap, a second plurality of O-rings is positioned around the laser module, a third plurality of O-rings is positioned around the body portion of the laser housing, and at least one O-ring is positioned in the O-ring groove of the projectile head;

applying a coating of one of petroleum jelly and silicone grease to the O-rings on the laser housing and the projectile head;

loading the laser guided projectile device into the PAN disrupter; and firing the laser guided projectile device from the PAN disrupter.

17. The method of claim 16 further comprising the steps of:

providing a muzzle adapter device comprising, in combination:

a substantially cylindrical body having a first end and a second end, wherein the first end is substantially tapered and adapted to be inserted in a muzzle end of a PAN disrupter;

an O-ring positioned proximate the first end; and an aperture longitudinally centered in the body, wherein the aperture is adapted to permit laser light from the laser guided projectile device to pass therethrough;

inserting the muzzle adapter device into the muzzle end of the PAN disrupter;

aiming the muzzle end of the PAN disrupter onto a light-colored background;

viewing a laser beam being emitted from the laser guided projectile device onto the background;

rotating the laser guided projectile device in a clockwise direction to obtain a bright laser spot; and removing the muzzle adapter device from the PAN disrupter prior to firing the laser guided projectile device from the PAN disrupter.

18. The method of claim 16 wherein the frontal portion of the projectile head is one of substantially rounded and cone-shaped.

19. The method of claim 16 wherein the frontal portion of the projectile head includes a concave portion defined by a substantially cone-shaped side wall and a base wall, the side wall having an upper sharpened edge.

20. The method of claim 16 wherein the frontal portion of the projectile head comprises a shot cup.

* * * * *